US006168875B1

(12) United States Patent
Cybulsky et al.

(10) Patent No.: US 6,168,875 B1
(45) Date of Patent: Jan. 2, 2001

(54) COATINGS FOR TURBINE COMPONENTS

(75) Inventors: Michael Cybulsky; Thomas B. Gibbons, both of Windsor, CT (US)

(73) Assignee: Asea Brown Boveri AG, Baden (CH)

( * ) Notice: Under 35 U.S.C. 154(b), the term of this patent shall be extended for 0 days.

(21) Appl. No.: 09/165,567

(22) Filed: Oct. 2, 1998

(51) Int. Cl.[7] ..... B32B 15/04; F03B 11/00

(52) U.S. Cl. ..... 428/633; 428/621; 428/662; 428/670; 416/241 R

(58) Field of Search ..... 428/633, 621, 428/662, 670; 416/241 R

(56) References Cited

U.S. PATENT DOCUMENTS 4,036,601 * 7/1977 Weimar et al. .
5,624,721 * 4/1997 Strangman .
5,914,189 * 6/1999 Hasz et al. .
5,993,976 * 11/1999 Sahoo et al. .

* cited by examiner

*Primary Examiner*—John J. Zimmerman
*Assistant Examiner*—Jason Savage
(74) *Attorney, Agent, or Firm*—Alix, Yale & Ristas, LLP

(57) ABSTRACT

An iridium-niobium alloy bond coat is used under a ceramic thermal barrier coating on turbine blades and vanes to improve the life of the thermal barrier coating. Between the bond coat and the substrate is an underlying protective coating which is either a low pressure plasma sprayed coating such as a NiCoCrAlY alloy or a vapor deposited coating such as tantalum, nickel-tantalum or rhenium. Heat treatment and preoxidation procedures may be used to form the desirable bonds and materials.

9 Claims, 1 Drawing Sheet

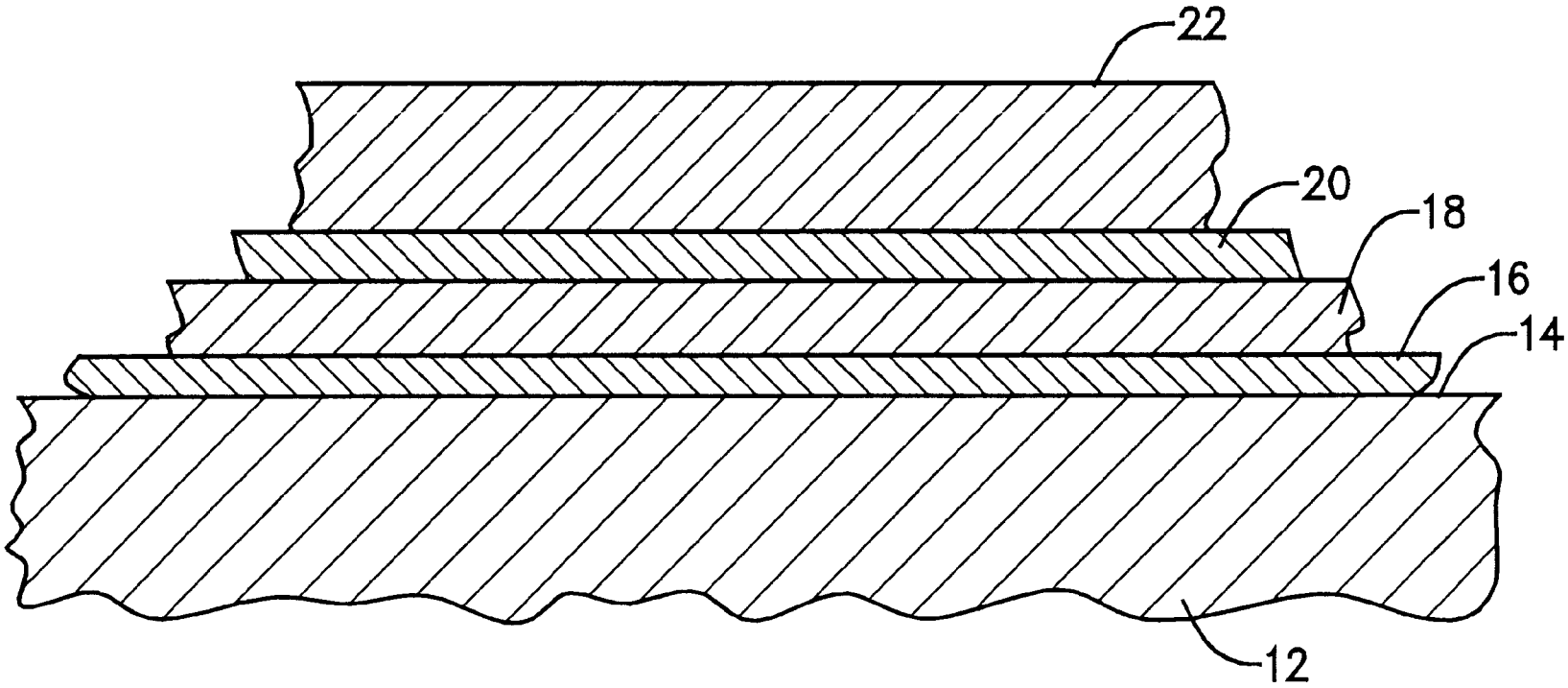
22
20
18
16
14
12

COATINGS FOR TURBINE COMPONENTS

The present invention relates to coatings for the blades and vanes of turbines and particularly relates to the bond coat that is used with a thermal barrier coating on turbine components.

BACKGROUND OF THE INVENTION

In order to improve the efficiency of gas turbines, it is necessary to apply ceramic thermal barrier coatings (TBC's) to the blade and vane components that are exposed to very high temperatures. These TBC's lower the material surface temperatures of the turbine blades/vanes and extend their life and reliability. In order to bond the TBC coatings to the ceramic surface of the blades/vanes, a bond coat is used which also provides oxidation and hot corrosion protection to the blades and vanes. Current bond coats are normally alumina forming systems such as platinum aluminide diffusion coatings or NiCoCrAlY overlays. Often other elements can be added to NiCoCrAlY overlays such as Si, Ta, etc. At high temperatures, oxygen diffuses through the ceramic TBC which results in oxide growth and cracks can initiate in the TBC. Eventually, due to stresses from the oxidation process and fatigue due to thermal cycling, the TBC can spall resulting in accelerated oxidation of the bond coat and possible failure of the entire coating system. Initially cracks are formed in the thermal barrier coatings due to the growth of oxide and thermal expansion differences between the TBC coatings, thermally grown alumina, and bond coats. Of course, cracking can also occur in TBC's for other reasons such as bond coat creep. The spallation of the TBC can result in accelerated oxidation of the bond coat. Normally, An, failure of the TBC occurs when the oxide thickness has grown to 5 to 25 microns below the ceramic TBC. To a large extent, for engines which are base loaded oxide growth of the bond coat can determine the life of the coating system.

SUMMARY OF THE INVENTION

The invention relates to improving the life of a thermal barrier coating (TBC) for turbine blades and vanes by the use of a high temperature bond coat with good oxidation resistance. Specifically, the invention relates to the use of an iridium-niobium (Ir—Nb) alloy bond coat under the TBC to firmly bond the TBC to the substrate or underlying layers. Between the bond coat and the substrate is an underlying protective coating of a low pressure plasma sprayed coating or a vapor deposited coating. The low pressure plasma sprayed coating is formed from a mixture of metal powders such as NiCoCrAlY which may also include other metals such as Si and Ta. Preferably, there is a diffusion barrier coating between the underlying protective coating and the blade/vane substrate to limit interdiffusion between the coatings and the substrate. The diffusion barrier can be a metallic system such as tantalum (Ta), nickel-tantalum (Ni—Ta), or rhenium (Re) or it can be a ceramic such as alumina which is especially effective when in an amorphous form. The bond coat is bonded to the underlying layers by a diffusion heat treatment. Further a preoxidation procedure can be performed on the bond coat in a high temperature oxidation furnace to form a desirable oxide structure on the surface of the bond coat prior to the application of the TBC.

BRIEF DESCRIPTION OF THE DRAWING

The drawing is a cross-section of a portion of a turbine blade or vane which has been coated in accordance with the present invention.

DESCRIPTION OF THE PREFERRED EMBODIMENT

Components in the "hot section" of gas turbines are subjected to very high temperatures and, in order to improve engine efficiency, it is necessary to protect the turbine blades and vanes from these high temperatures. This is done by applying a thermal barrier coating (TBC) and a cooling system to these components which results in lower metal surface temperatures. Shown in the drawing is a portion of a gas turbine blade or vane 12 having a surface 14. These components are typically made from a nickel bate superalloy, although the present invention is not limited to any particular blade or vane alloy.

The first step in the procedure for forming the coating system of the present invention, which is optional, is to form a diffusion barrier coating 16 primarily for the purpose of limiting the interdiffusion between the bond coat and substrate. Such coatings are preferably either a ceramic or metallic coating and preferably are amorphous (non-crystalline). Typically diffusion barrier coatings are Ta, Ni—Ta, Re or ceramics such as alumina but may include other elements and typically the thickness range is from 1 micrometer to in excess of 25 micrometers.

The next step in the process is the application of what is referred to as an underlying protective coating 18 for the purpose of oxidation and hot corrosion protection. This coating can be an overlay applied by low pressure plasma spraying of powder mixtures such as the previously mentioned prior art overlay of NiCoCrAlY and can contain other elements such as Si, Ta, and Re. This coating will form a protective layer and is typically 50 to over 500 micrometers thick. In place of the low pressure plasma sprayed coating such as NiCoCrAlY, the protective coatings 18 may be an aluminide (NiAl or CoAl) or a platinum aluminide coating applied by vapor deposition. These latter coatings are normally in the range of 10 micrometers to 150 micrometers thick and are normally applied in conjunction with an electron beam deposited thermal barrier coating. The NiCoCrAlY protective coatings are normally used with thermal barrier coatings applied by air plasma spray.

The next step in the process of forming the coating system of the present invention is the application of the bond coat 20 of the iridium-niobium (Ir—Nb) alloy which functions to bond the ceramic thermal barrier coating to the substrate or intervening layers below. The Ir—Nb coating is an alloy of 60 to 95 atomic percent iridium and 5 to 40 atomic percent niobium. The thickness is in the range of 1 to 20 micrometers and it may be applied by any desired technique such as low pressure plasma spraying or sputtering. After applying the bond coat 20 of the Ir—Nb alloy, a heat treatment is performed to bond the alloy to the substrate or the intervening coating. This heat treatment is at a temperature in the range of 1000° C. to 1200° C. and preferably 1080° C. for four hours. The next step can be a preoxidation step to form an oxide layer. This oxidation step is performed in a high temperature furnace in air.

Once the Ir—Nb bond coat has been applied and heat treated and preoxidized if desired, the final TBC 22 is applied by plasma spraying or electron beam vapor deposition. The ceramic thermal barrier coating is usually a mixture of $ZrO_2$ with 6 to 8 weight % $Y_2O_3$ stabilizer with a thickness in the range of 100 micrometers to over 1 millimeter. Other stabilizers can be used in place of yittria ($Y_2O_3$) such as cerium and scandia among others.

The coating system of the present invention provides a bond between the TBC and the substrate which will withstand high temperatures and which has excellent oxidation resistance thereby improving the long term performance of the coating system.

What is claimed is:

1. A coating system for turbine blade and vane components comprising:

a. a bond coat applied to said components comprising an iridium-niobium alloy having 60–95 atomic percent iridium and 5 to 40 atomic percent niobium, and b. a ceramic thermal barrier coating applied to said components over said bond coat.

2. A coating system as recited in claim 1 wherein said bond coat has a thickness in the range of about 1 to 20 micrometers and said ceramic thermal barrier coating has a thickness in the range of about 100 micrometers to over 1 millimeter.

3. A coating system as recited in claim 1 wherein said ceramic thermal barrier coating comprises a mixture of zirconium oxide and a stabilizer.

4. A coating system as recited in claim 3 wherein said ceramic thermal barrier coating comprises zirconium oxide with 6 to 8 weight percent yttrium oxide.

5. A coating system as recited in claim 3 and further including a protective coating between said bond coat and said components.

6. A coating system as recited in claim 5 wherein said protective coating is selected form the group consisting of low pressure plasma sprayed metal powders and vapor deposited aluminides.

7. A coating system as recited in claim 5 wherein said protective coating is low pressure plasma sprayed metal powders of NiCoCrAlY.

8. A coating system as recited in claim 6 and further including a diffusion barrier coating between said protective coating and said component.

9. A coating system as recited in claim 8 wherein said diffusion barrier coating is selected from the group consisting of tantalum, nickel-tantalum, rhenium and alumina.

* * * * *